US010005091B2

(12) United States Patent
Lo

(10) Patent No.: US 10,005,091 B2
(45) Date of Patent: Jun. 26, 2018

(54) IRRIGATION SPRINKLER

(71) Applicant: YUAN MEI CORP., Lugang Township, Chuanghua County (TW)

(72) Inventor: Shun-Nan Lo, Lugang Township, Changhua County (TW)

(73) Assignee: Yuan Mei Corp., Lugang Township, Changhua County (TW)

( * ) Notice: Subject to any disclaimer, the term of this patent is extended or adjusted under 35 U.S.C. 154(b) by 95 days.

(21) Appl. No.: 15/068,161

(22) Filed: Mar. 11, 2016

(65) Prior Publication Data

US 2016/0303584 A1 Oct. 20, 2016

Related U.S. Application Data

(63) Continuation-in-part of application No. 14/685,606, filed on Apr. 14, 2015.

(51) Int. Cl.

*B05B 3/00* (2006.01)
*B05B 3/04* (2006.01)
*B05B 1/16* (2006.01)

(52) U.S. Cl.

CPC ..... *B05B 3/0422* (2013.01); *B05B 1/169* (2013.01); *B05B 1/1645* (2013.01); *B05B 3/0431* (2013.01)

(58) Field of Classification Search

CPC ..... B05B 1/169; B05B 1/1645; B05B 1/267; B05B 3/0422; B05B 3/0431; B05B 15/001; B05B 15/10; B05B 3/044; B05B 15/08; B05B 1/14; A01G 25/00

USPC ..... 239/200–202, 207, 237, 242, 243, 239/288–288.5

See application file for complete search history.

(56) References Cited

U.S. PATENT DOCUMENTS 7,090,146 B1 * 8/2006 Ericksen ..... B05B 3/0431 239/200
8,336,788 B2 * 12/2012 Perkins ..... B05B 3/0486 239/122
2003/0042327 A1 * 3/2003 Beutler ..... B05B 3/0431 239/201
2007/0095935 A1 * 5/2007 Katzman ..... B05B 3/0486 239/204
2014/0263735 A1 * 9/2014 Nations ..... B05B 3/021 239/232

* cited by examiner

*Primary Examiner* — Arthur O Hall
*Assistant Examiner* — Adam J Rogers
(74) *Attorney, Agent, or Firm* — Muncy, Geissler, Olds & Lowe, P.C.

(57) ABSTRACT

An irrigation sprinkler includes an engagement component connecting a cap component to a base by a converging movement. The base includes a holding member; the cap component includes an anchor member; and the engagement component includes a first male member and a first female member mating with each other. The first male member is alternatively arranged on the holding member and the anchor member, and the first female member is arranged on the other. Therefore, the first male member non-releasably couples with the first female member by a movement toward each other, and the first engagement component connects the cap component to the base. An indication component couples with the cap component offers visual recognition of the selected one of nozzles.

17 Claims, 16 Drawing Sheets

IRRIGATION SPRINKLER

CROSS-REFERENCE TO RELATED APPLICATION

This application is a continuation in part of U.S. patent application Ser. No. 14/685,606 filed on Apr. 14, 2015 entitled "ABOVE GROUND SPRINKLER", the content of which is hereby incorporated by reference in its entirety.

BACKGROUND OF THE INVENTION

1. Technical Field

The present invention relates to a sprinkler, specifically to an irrigation sprinkler with multiple selectable nozzles.

2. Background of the Invention

For irrigation sprinkler, it is known to arrange multiple nozzles on a head which can be rotated to align one of the nozzles with the water inlet US Patent No. U.S. Pat. No. 7,090,146 B1, titled "Above-Ground Adjustable Spray Pattern Sprinkler", discloses an above-ground sprinkler having a head that rotates about an angle determined by the relative angles between a pair of arc adjustment rings.

The head further includes a cover and a flow control member. The flow control member is attached to the cover by an attachment screw, so that the flow control member could rotate about the attachment screw for allowing the user to select any nozzle with ease. However, the application of the attachment screw complicates the assembly step. In addition, the sprinkler offers no simple visual indication to which nozzle is being selected or the direction of the spray. For clarity, "cover" will henceforth be referred as "base" and "flow control member" will henceforth be referred as "nozzle assembly".

In the interest of assembly economic and user friendliness, a sprinkler which can be fabricated straightforward and assembled with easy manipulation is desired.

SUMMARY

It is therefore for one or more aspects to provide an irrigation sprinkler of convenient assembly without screws.

It is therefore for one or more aspects to provide an irrigation sprinkler of easy manipulation for users fully grasping the irrigation sprinkler from top to rotate a nozzle assembly of the irrigation sprinkler.

It is therefore for one or more aspects to provide an irrigation sprinkler with visual identification for users recognizing the selected nozzle.

To achieve the present disclosure mentioned above, an irrigation sprinkler, adapted for connecting to a water source, is disclosed. The irrigation sprinkler includes a base, a nozzle assembly, a cap component, a first engagement component, and an indication component. The base defines an orifice communicating with the water source, and includes a holding member disposed thereon. The nozzle assembly slideably attaches to the base and is capable of rotating around a generally vertical axis of the base; the nozzle assembly defines a passage through which the holding member of the base penetrates; the nozzle assembly further defines a plurality of nozzles circumferentially arranged thereof and spaced apart. The cap component sits over the base and the nozzle assembly; the cap component includes an anchor member disposed thereof. The first engagement component includes a first male member and a first female member; the first male member is alternatively arranged on the holding member of the base and the anchor member of the cap component, and the first female member is arranged on the other; the first male member non-releasably couples with the first female member by a converging movement between the holding member and the anchor member, and the first engagement component connects the cap component to the base. The nozzle assembly is thereby restrained from vertical movement. The indication component couples with the cap component and corresponds to the orifice of the base. As a rotation of the nozzle assembly takes place, the indication component aligns a selected one of the nozzles, which communicates with the orifice of the base, and offers visual recognition of the selected one of the nozzles.

Other advantages and features of the present disclosure will be fully understood by reference to the following specification in conjunction with the accompanying drawings, in which like reference signs denote like components of structure.

DETAILED DESCRIPTION

Figure 1:
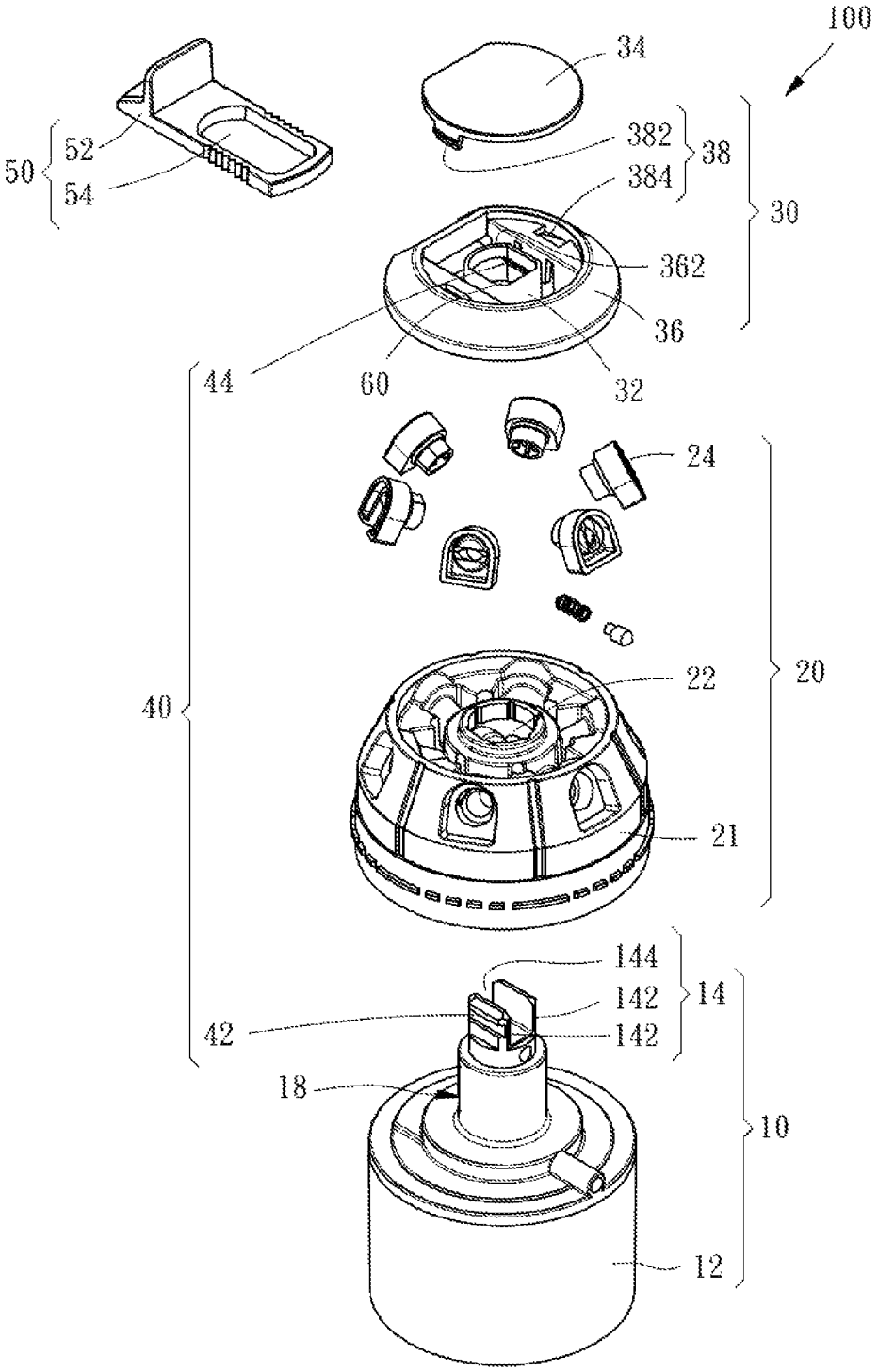
FIG. 1 is an explosion view illustrating an irrigation sprinkler in accordance to a first embodiment of the present disclosure.
Figure 2:
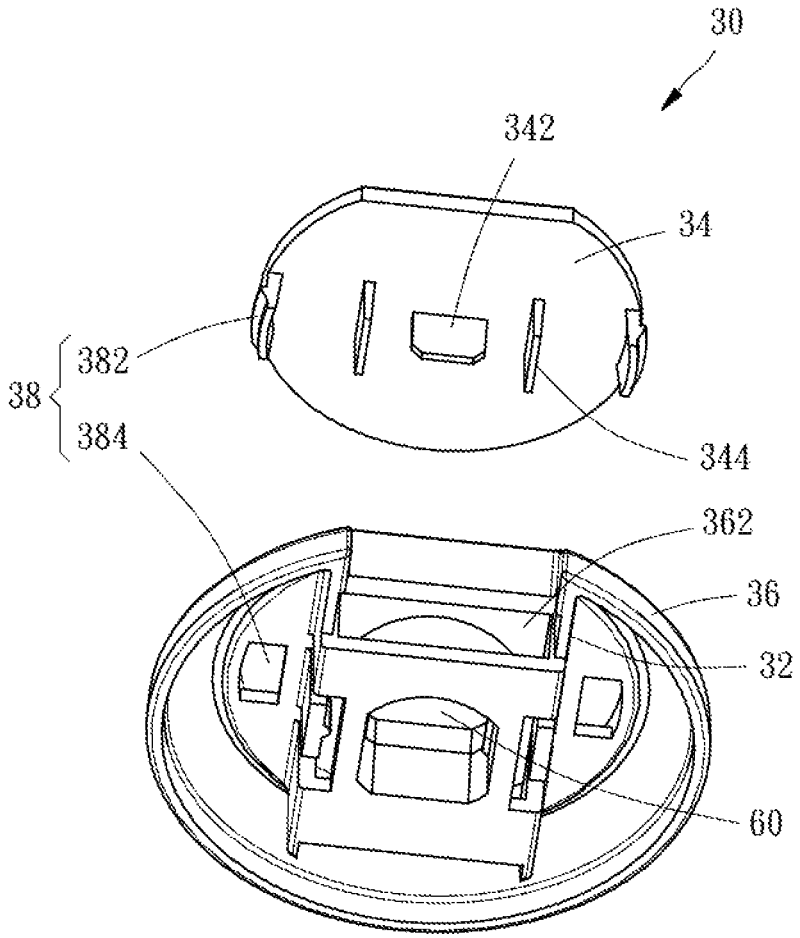
FIG. 2 is a perspective view illustrating parts in FIG. 1.
Figure 3:
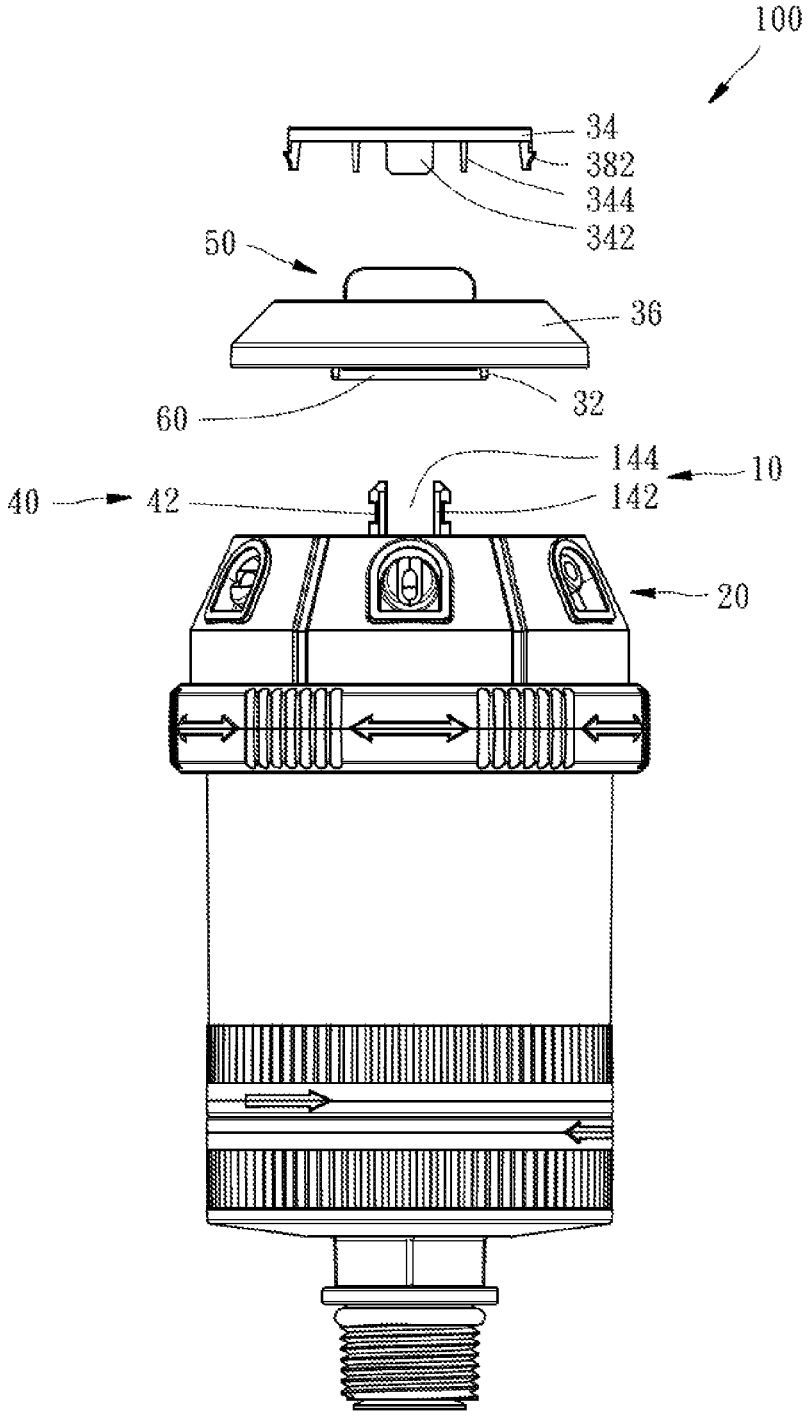
FIG. 3 is an explosion view with partial assembly according to FIG. 1.
Figure 4:
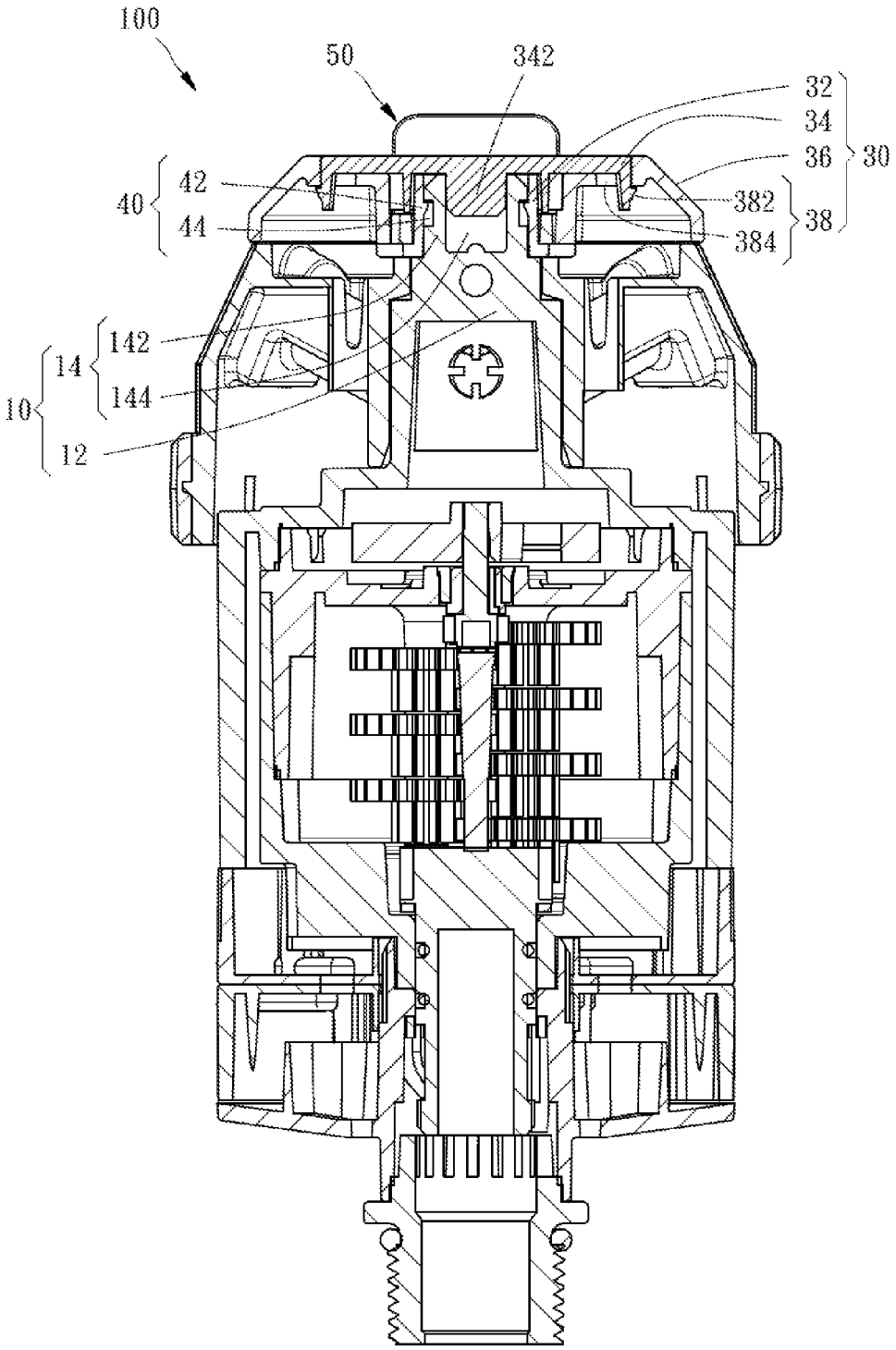
FIG. 4 is a cross-sectional profile in accordance to first embodiment of the present disclosure.
Figure 5:
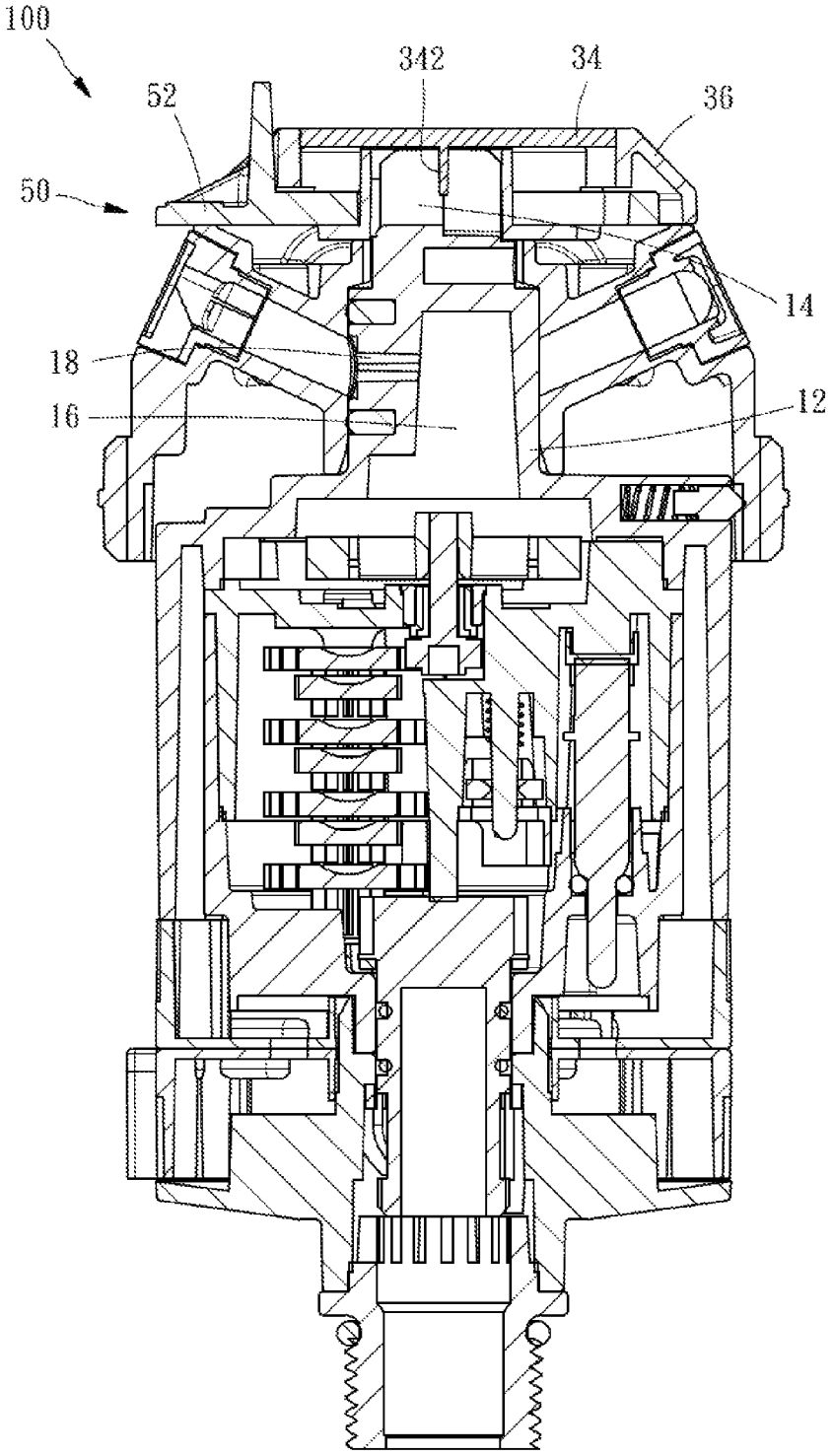
FIG. 5 is another cross-sectional profile in accordance to first embodiment of the present disclosure.

The present disclosure relates to an irrigation sprinkler 100 adapted for connecting to a water source. The irrigation sprinkler 100 according to the embodiments of the present disclosure will be described with reference to the drawings. Repeated description thereof may be omitted.

First Embodiment

FIGS. 1 through 5 pertain to a first embodiment of the present disclosure. The irrigation sprinkler 100 includes a base 10, a nozzle assembly 20, a cap component 30, a first engagement component 40, and an indication component 50.

The base 10 includes a foundation member 12, and a holding member 14 disposed on the foundation member 12; the base 10 defines an outlet channel 16 formed in the foundation member 12 and communicating with the water source, and an orifice 18 formed on the foundation member 12 and communicating with the outlet channel 16.

The nozzle assembly 20 slidably attaches to the base 10 and is capable of rotating around a generally vertical axis of the base 10. The nozzle assembly 20 defines a housing 21, a passage 22 formed through the housing 21, and a plurality of nozzles 24 circumferentially arranged on the housing 21 and spaced apart. Usually, the nozzles 24 are set around the generally vertical axis of the base 10, and could be integrally made with the housing 21 or be individually arranged in the housing 21. The holding member 14 of the base 10 penetrates the passage 22 of the housing 21. The nozzles 24 offer various spray patterns.

The cap component 30 sits over the base 10 and the nozzle assembly 20. The cap component 30 includes an anchor member 32 disposed on a bottom exterior thereof in order to correspond to the holding member 14 of the base 10.

The first engagement component 40 includes a first male member 42 and a first female member 44 mating with each other. The first male member 42 is alternatively arranged on the holding member 14 of the base 10 and the anchor member 32 of the cap component 30, and the first female member 44 is arranged on the other. The first male member 42 non-releasably couples with the first female member 44 so that the first engagement component 40 connects the cap component 30 to the base 10. More specifically, the first male member 42 non-releasably couples with the first female member 44 by a converging movement between the holding member 14 and the anchor member 32. The nozzle assembly 20 is consequently restrained between the cap component 30 and the base 10.

The indication component 50 couples with the cap component 30 and corresponds to the orifice 18 of the base 10. A rotation of the nozzle assembly 20 enables the indication component 50 to align with a selected one of the nozzles 24, which is chosen to communicate with the orifice 18 of the base 10, the indication component 50 consequently offers visual recognition of the selected one of the nozzles 24.

A reception 60 is arranged on the anchor member 32 of the cap component 30 for accommodating the holding member 14 of the base 10.

Further in detail, the cap component 30 includes a lid 34, a retainer cover 36, and a second engagement component 38 coupling the lid 34 to the retainer cover 36. The second engagement component 38 includes two male clips 382 arranged to and beneath the lid 34, and two female slits 384 arranged on the retainer cover 36 mated with the two male clips 382 respectively. The anchor member 32 is arranged on the retainer cover 36. Since the first engagement component 40 connects the anchor member 32 to the holding member 14, both of the lid 34 and the retainer cover 36 of the cap component 30 are non-releasable to the base 10 in this case.

Further in detail, the holding member 14 of the base 10 includes two resilient plates 142 opposite to each other and corresponding to the anchor member 32, and a gap 144 formed between the two resilient plates 142. The first female member 44 is a recessed groove arranged on each of the two resilient plates 142, and the first male member 42 is a pair of protruded bulges arranged on the anchor member 32. The first engagement component 40 connects the resilient plates 142 of the holding member 14 to the retainer cover 36. A wall 342 and two opposite abutting plates 344 extend from bottom of the lid 34. The wall 342 reaches into the gap 144 of the holding member, thereby pressing the two resilient plates 142 against the anchor member 32.

Further in detail, the retainer cover 36 defines a slot 362 formed transversely thereof and corresponding to the orifice 18 of the base 10. The indication component 50 defines a slide tab 52, and an opening 54 formed on the slide tab 52. The slide tab 52 glides within the slot 362 of the retainer cover 36; the two abutting plates 344 of the lid 34 retain the slide tab 52 in the slot 362. The anchor member 32 travels within the opening 54 while the slide tab 52 glides; it thereby prevents the slide tab 52 from completely gliding out of the slot 362 and becomes loose. The slide tab 52 itself not only functions as means of adjusting the water spray, but also offers the recognition of the spray direction of the sprinkler 100.

Figure 14:
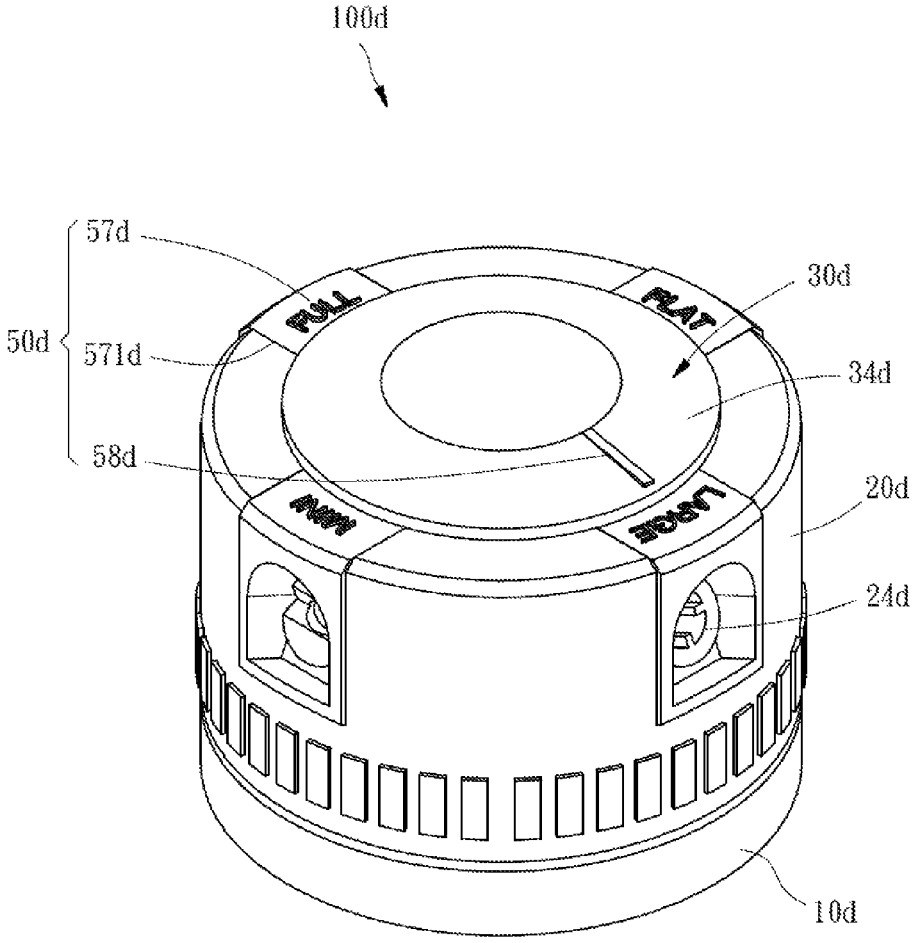
FIG. 14 is a perspective view in illustrating an irrigation sprinkler in accordance to a fifth embodiment of the present disclosure.

In an alternative embodiment (not illustrated), the cap component 30 is one-piece and defines a slot, and the slide tab defines two resilient tabs which pass through the slot and retains the slide tab in place. Refer to FIG. 14 of U.S. Pat. No. 7,255,291 for more details.

Second Embodiment

Figure 6:
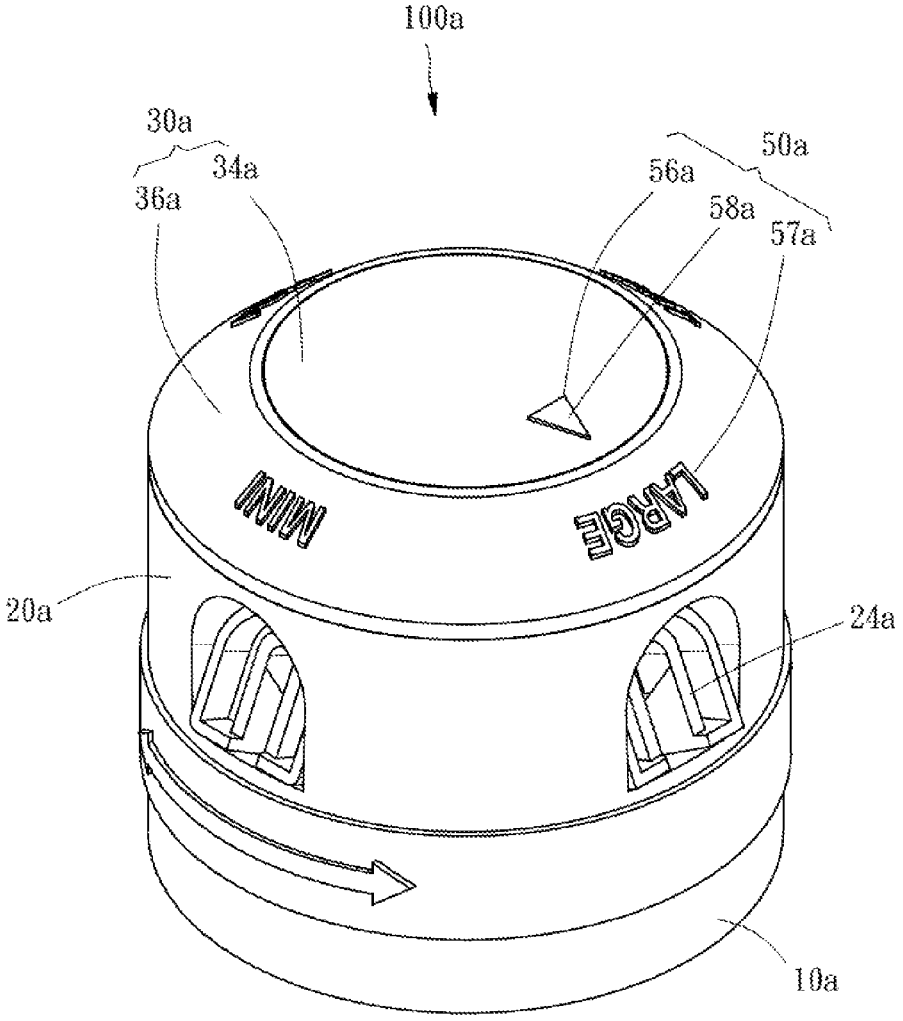
FIG. 6 is a perspective view in illustrating an irrigation sprinkler in accordance to a second embodiment of the present disclosure.
Figure 7:
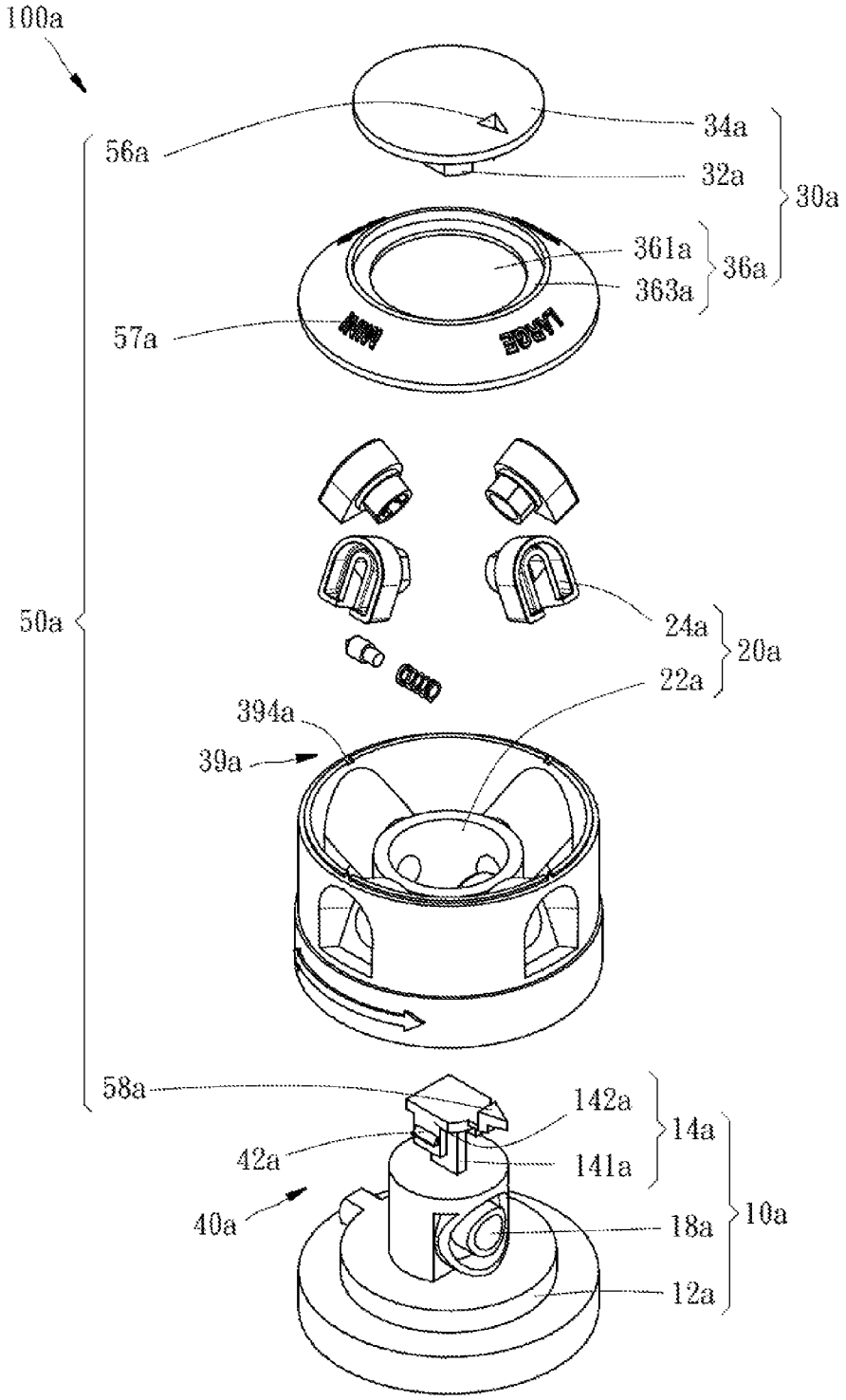
FIG. 7 is an explosion view in a top perspective illustrating an irrigation sprinkler in accordance to the second embodiment of the present disclosure.
Figure 8:
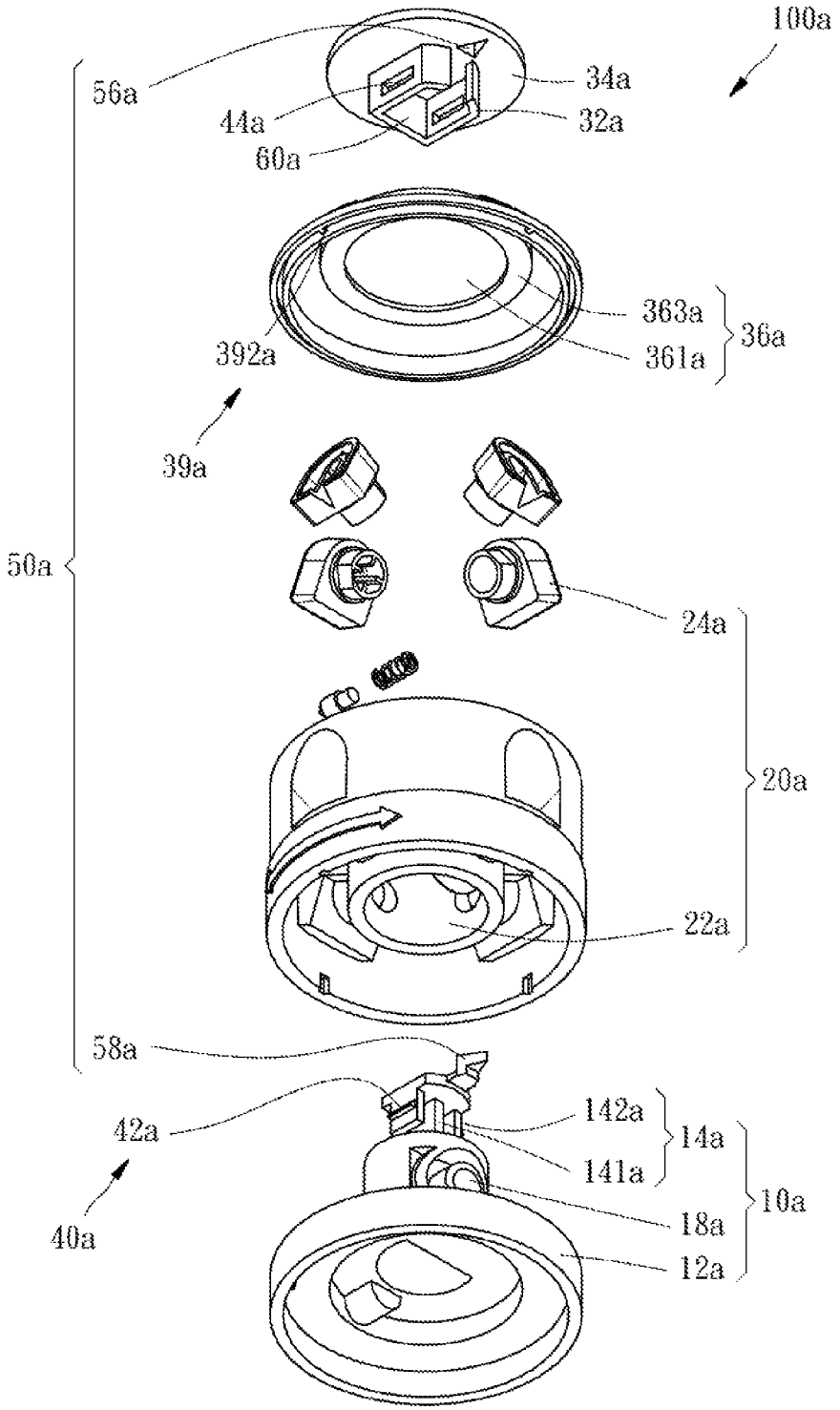
FIG. 8 is an explosion view in a bottom perspective illustrating an irrigation sprinkler in accordance to the second embodiment of the present disclosure.

FIGS. 6 to 8 pertain to a second embodiment of the present disclosure. The irrigation sprinkler **100*a* includes a base 10*a*, a nozzle assembly 20*a*, a cap component 30*a*, a first engagement component 40*a*, and an indication component 50*a***.

The base **10*a* includes a foundation member 12*a*, and a holding member 14*a* disposed on the foundation member 12*a*; the base 10*a* defines an outlet channel (not illustrated) formed in the foundation member 12*a* and communicating with the water source, and an orifice 18*a* formed on the foundation member 12*a*** and communicating with the outlet channel.

The nozzle assembly **20*a* slideably attaches to the base 10*a* and is capable of rotating around a generally vertical axis of the base 10*a*. The nozzle assembly 20*a* defines a passage 22*a* formed therein and a plurality of nozzles 24*a* circumferentially arranged thereof and spaced apart. The holding member 14*a* of the base 10*a* penetrates the passage 22*a* of the nozzle assembly 20*a*. The nozzles 24*a*** offer various spray patterns.

The cap component **30*a* sits over the base 10*a* and the nozzle assembly 20*a*. The cap component 30*a* includes an anchor member 32*a*, a lid 34*a*, a retainer cover 36*a*, and a third engagement component 39*a* coupling the retainer cover 36*a* to the nozzle assembly 20*a*. The retainer cover 36*a* is relatively movable to the lid 34*a*. The retainer cover 36*a* is non-rotatable to the nozzle assembly 20*a* because the third engagement component 39*a* connects the retainer cover 36*a* to the nozzle assembly 20*a***.

In this case, the anchor member **32*a* disposes on a bottom of the lid 34*a* and corresponds to the holding member 14*a* of the base 10*a***.

The third engagement component 39*a* includes at least one third male member 392*a* arranged on the retainer cover 36*a*, and at least one third female member 394*a* arranged on the nozzle assembly 20*a* and mating with third male member 392*a*. The retainer cover 36*a* is non-rotatable to the nozzle assembly 20*a* because the third engagement component 39*a* connects the retainer cover 36*a* to the nozzle assembly 20*a*. The third engagement component 39*a* does not refer to the character of the present disclosure and may not be restrained by structure mentioned above.

The first engagement component 40*a* includes a first male member 42*a* and a first female member 44*a* mating with each other. The first male member 42*a* non-releasably couples with the first female member 44*a* by a converging movement of the holding member 14*a* and the anchor member 32*a* toward each other, so that the first engagement component 40*a* connects the cap component 30*a* to the base 10*a*. The nozzle assembly 20*a* is consequently restrained after the converging movement by the cap component 30*a* and the base 10*a*.

The indication component 50*a* includes a sign window 56*a* and a sign portion 58*a* corresponding with each other; the sign window 56*a* is formed on the lid 34*a* of the cap component 30*a* and aligns with the orifice 18*a* of the base 10*a*. The sign portion 58*a* extends from the holding member 14*a* of the base 10*a* toward the lid 34*a* of the component 30*a* for fitting in the sign window 34*a* of the cap component 30*a;* the sign portion 58*a* sequentially is visible on the cap component 30*a*. Furthermore, the indication component 50*a* includes a plurality of marks 57*a* set on the retainer cover 36*a* and respectively coincided with the nozzles 24*a;* the sign portion 58*a* is capable of pointing out a selected one of the marks 57*a* after the retainer cover 36*a* synchronously rotates with the nozzle assembly 20*a*.

A reception 60*a* is arranged on the anchor member 32*a* of the cap component 30*a* for accommodating the holding member 14*a* of the base 10*a*.

Further in detail, the holding member 14*a* of the base 10*a* includes a T-shaped pillar 141*a*, and two opposing resilient plates 142*a* extend from two lateral sides of the T-shaped pillar 141*a* and parallel with each other. The first male member 42*a* is a clip tab arranged on each of the two resilient plates 142*a*, and the first female member 44*a* is a pair of mounting holes arranged on the anchor member 32*a*. The first engagement component 40*a* connects the resilient plates 142*a* of the holding member 14*a* to the lid 34*a* while the clip tab fits in the mounting hole.

Further in detail, the retainer cover 36*a* has an opening 361*a* and an interior stage 363*a*. The lid 34*a* sits on the interior stage 363*a* of the retainer cover 36*a*.

In an alternative embodiment (not illustrated), the first female member 44*a* is a mounting hole arranged on each of the two resilient plates 142*a* of the holding member 14*a* of the base 10*a*, and the first male member 42*a* is a pair of clip tabs arranged on the anchor member 32*a* of the cap component 30*a*.

In an alternative embodiment (not illustrated), the third engagement component include a plurality of male members disposed on the retainer cover 36*a*, and at least one male member disposed on the nozzle assembly 20*a*, wherein the plurality of male members define at least one space, and the at least one male member is retained in the space.

Third Embodiment

Figure 9:
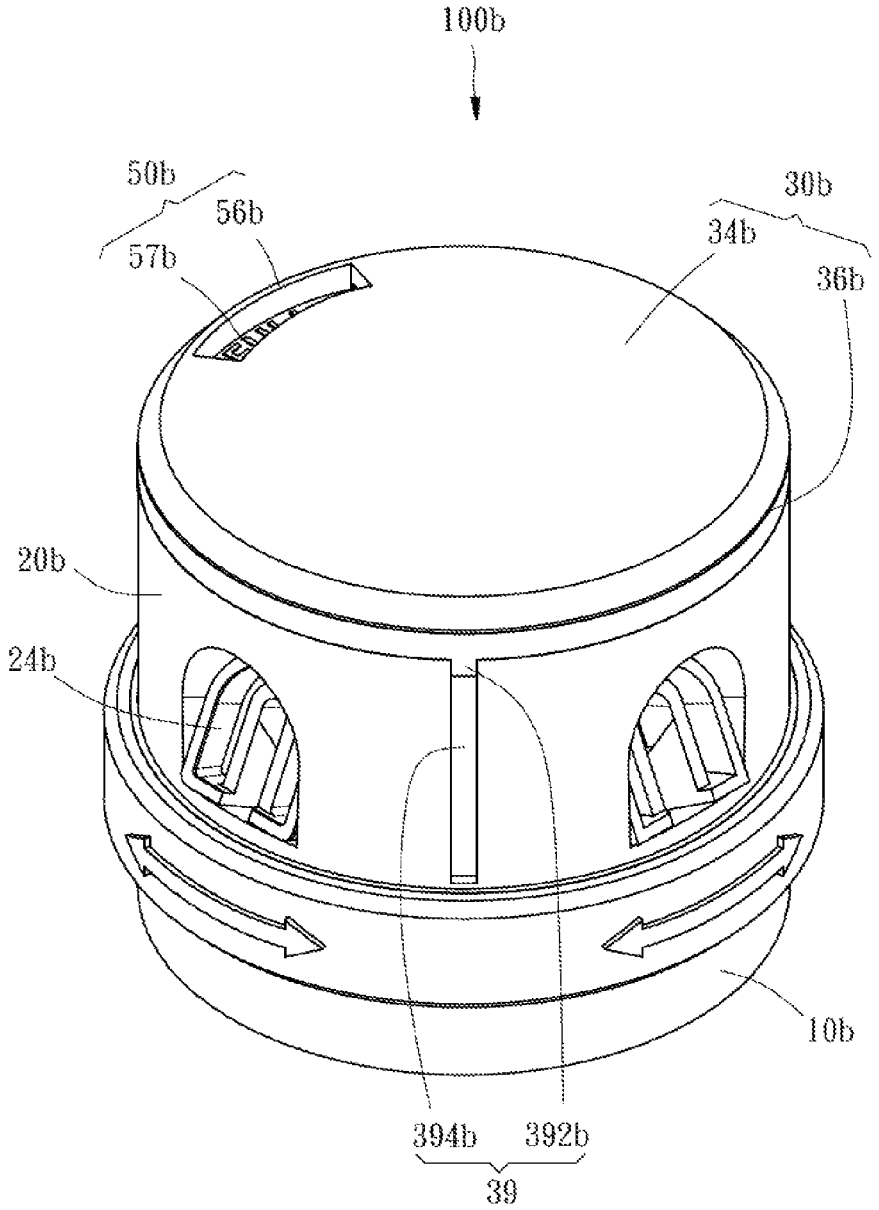
FIG. 9 is a perspective view in illustrating an irrigation sprinkler in accordance to a third embodiment of the present disclosure.
Figure 10:
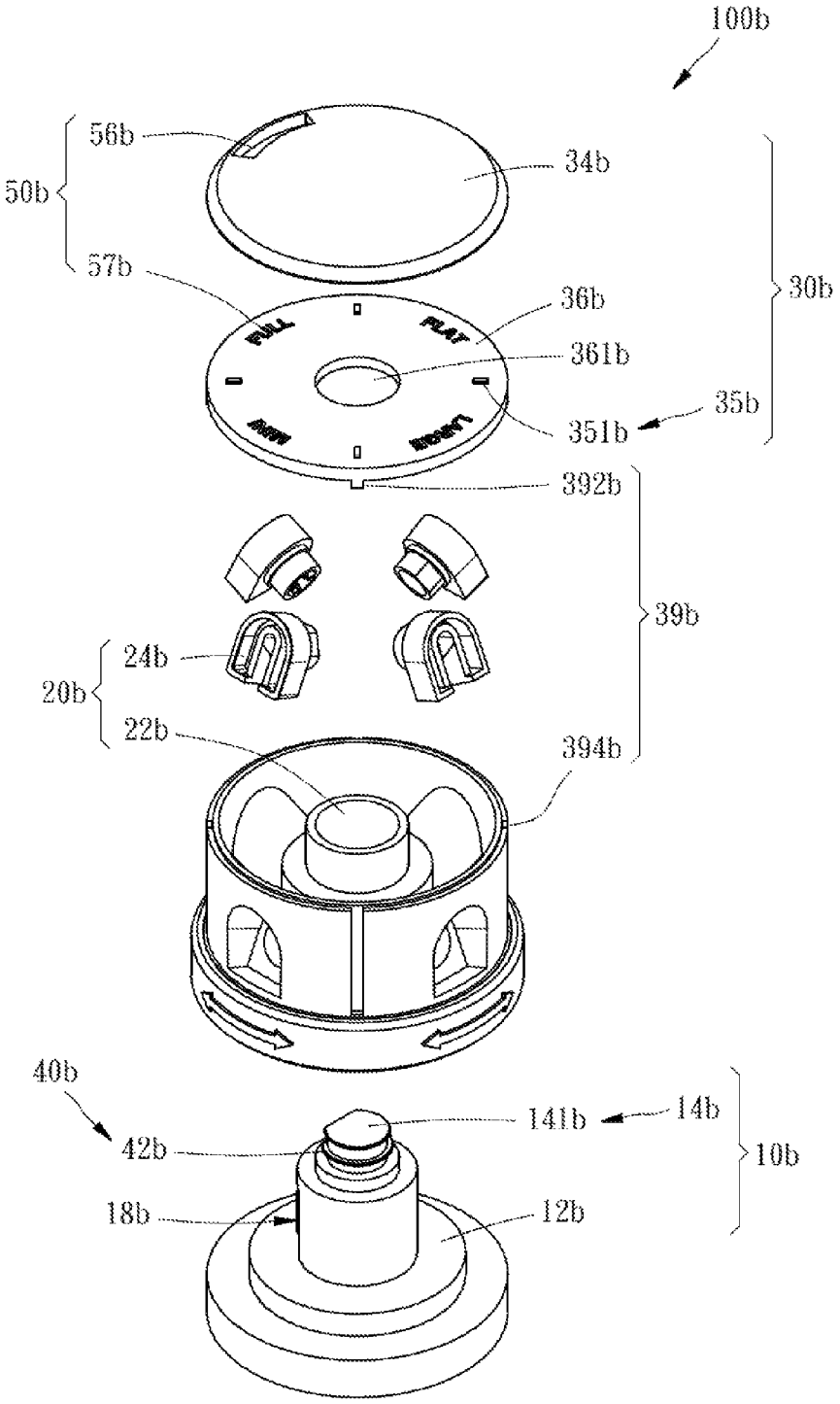
FIG. 10 is an explosion view in a top perspective illustrating an irrigation sprinkler in accordance to the third embodiment of the present disclosure.
Figure 11:
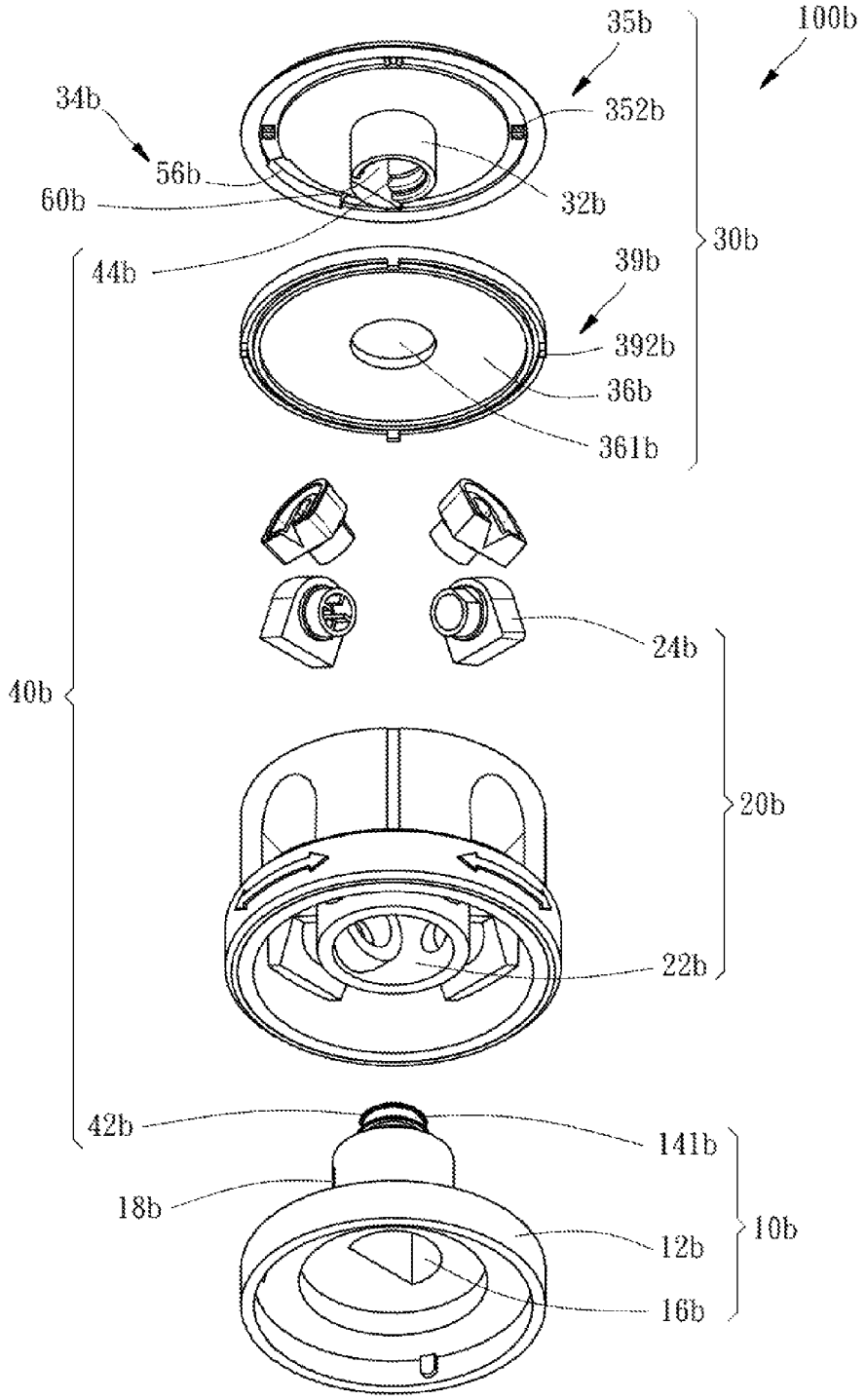
FIG. 11 is an explosion view in a bottom perspective illustrating an irrigation sprinkler in accordance to the third embodiment of the present disclosure.

FIGS. 9 to 11 pertain to a third embodiment of the present disclosure, which is similar to the second embodiment in that it includes a base 10*b*, a nozzle assembly 20*b*, a cap component 30*b*, a first engagement component 40*b*, and an indication component 50*b*.

The base 10*b* has a foundation member 12*b*, and a holding member 14*b* disposed on the foundation member 12*b*. In this case, the holding member 14*b* includes a pillar 141*b* having a non-circular cross-section.

The nozzle assembly 20*b* defines a plurality of nozzles 24*b*.

The cap component 30*b* sits over the base 10*b* and the nozzle assembly 20*b*. The cap component 30*b* includes a lid 34*b*, an anchor member 32*b* disposes on the lid 34*b*, a retainer cover 36*b*, and a third engagement component 39*b* coupling the retainer cover 36*b* to the nozzle assembly 20*b*. The retainer cover 36*b* is relatively movable to the lid 34*b*, and has an opening 361*b*. The lid 34*b* sits upon the retainer cover 36*b*.

A reception 60*b* is arranged on the anchor member 32*b* of the cap component 30*b*, and being contoured as same as the pillar 141*b*, so that the anchor member 32*b* of the cap component 30*b* fits with the pillar 141*b* of the holding member 14*b* of the base 10*b*.

The first engagement component 40*b* includes a first male member 42*b* and a first female member 44*b* mating with each other. The first male member 42*b* is a protruded bulge arranged on the pillar 141*b* of the holding member 14*b* of the base 10*b*, and the first female member 44*b* is a recessed groove arranged on the anchor member 32*b* of the cap component 30*b*. The first engagement component 40*b* connects the pillar 141*b* of the holding member 14*b* to the lid 34*b* of the cap component 30*b* via a converging movement by the holding member 14*b* toward the anchor member 32*b*.

The indication component 50*b* includes a sign window 56*b* and a plurality of marks 57*b*. The sign window 56*b* is formed on the lid 34*b* of the cap component 30*b* and aligns with an orifice 18*b* disposed on the base 10*b*. The marks 57*b* are set on the retainer cover 36*b* and respectively coincided with the nozzles 24*b;* the sign window 56*b* is capable of revealing a selected one of the marks 57*b* after the retainer cover 36*b* synchronously rotates with the nozzle assembly 20*b*.

Further in detail, the cap component 30*b* includes positioning means 35*b*. The positioning means 35*b* includes at least one bump 35 lb set on a top exterior of the retainer cover 36*b* and at least one positioning rail 352*b* formed on the bottom exterior of the lid 34*b*. The positioning rail 352*b* defines a plurality of notches for retaining the bump 351*b*.

Fourth Embodiment

Figure 12:
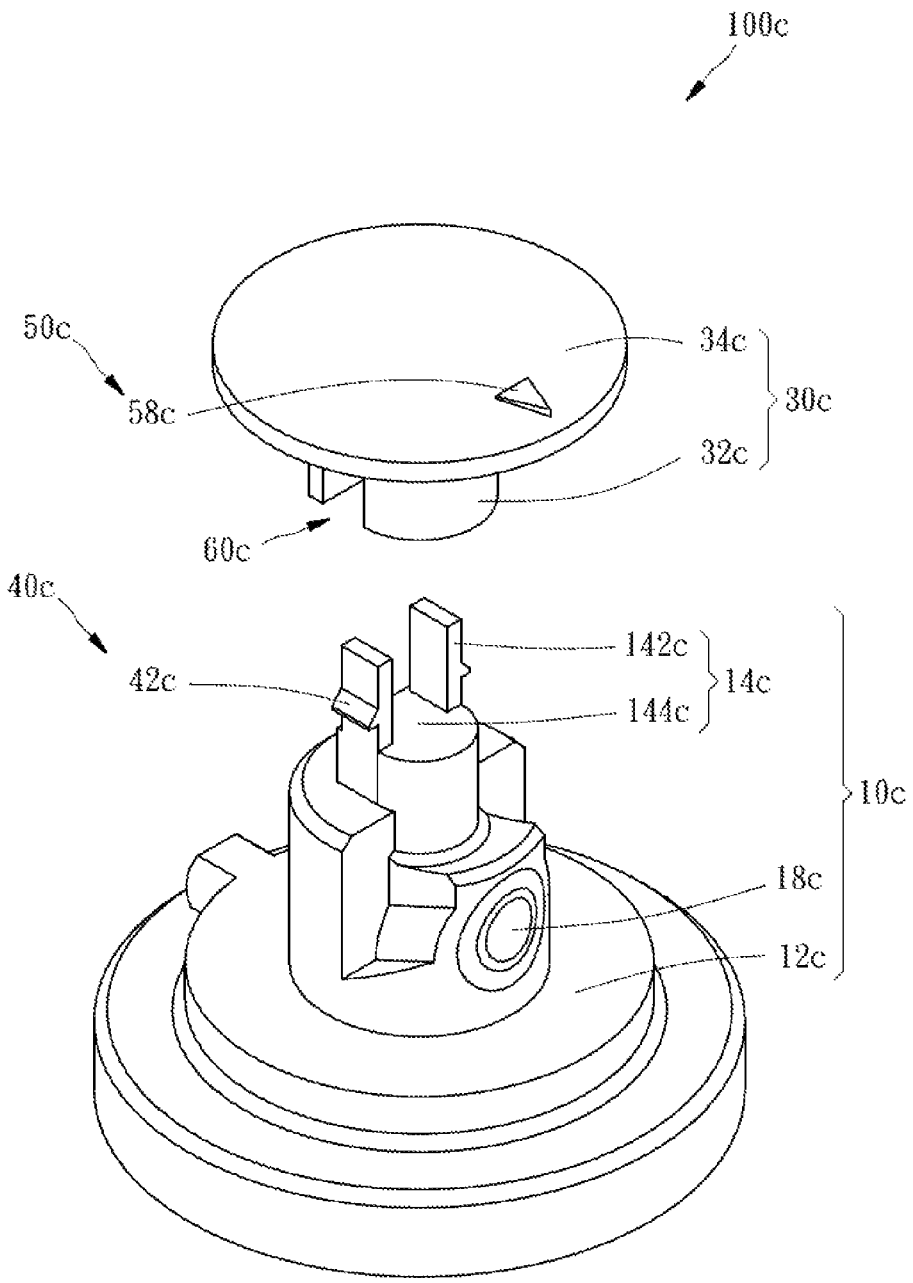
FIG. 12 is an explosion view in a top perspective illustrating an irrigation sprinkler in accordance to a fourth embodiment of the present disclosure.
Figure 13:
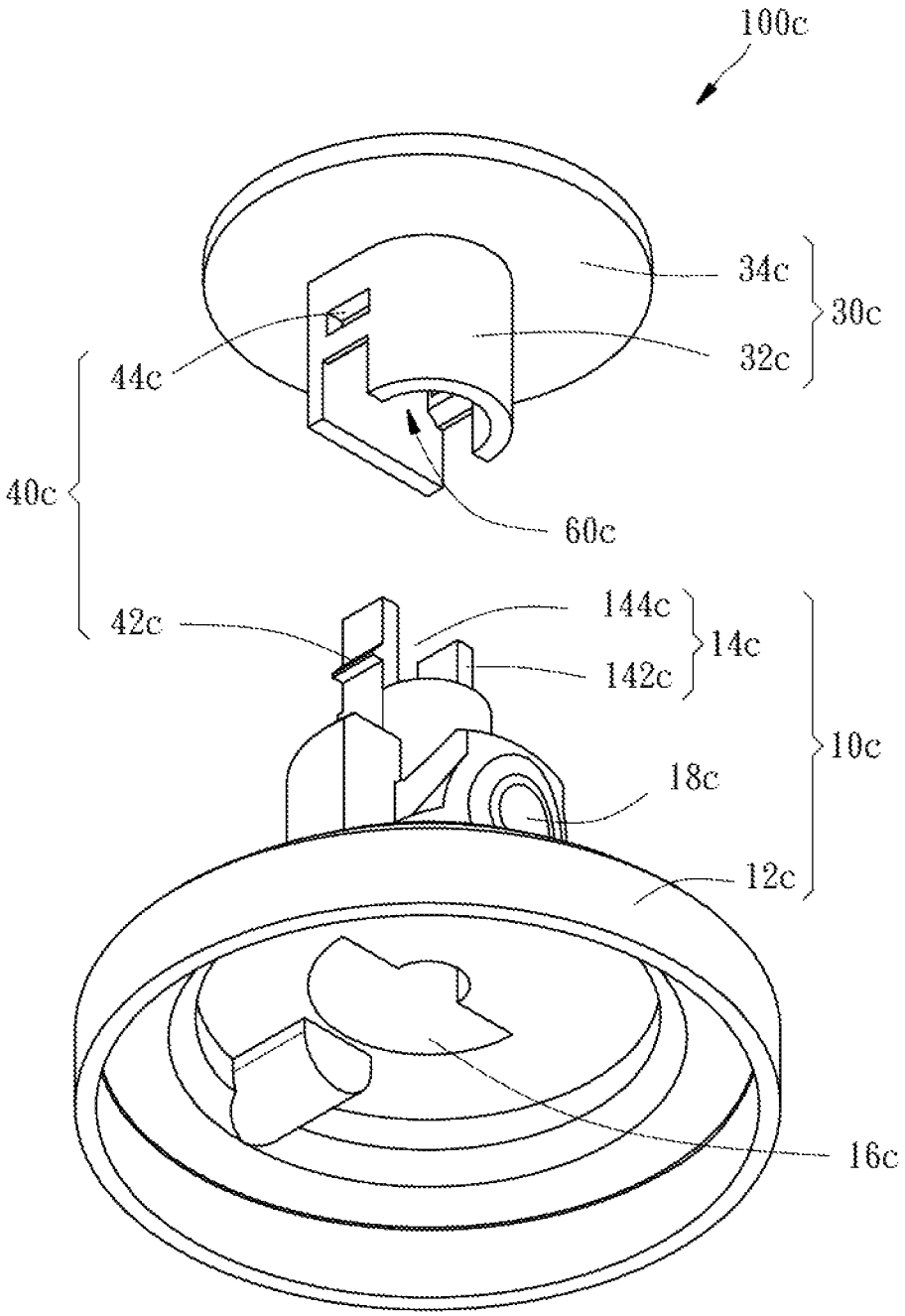
FIG. 13 is an explosion view in a bottom perspective illustrating an irrigation sprinkler in accordance to the fourth embodiment of the present disclosure.

FIGS. 12 and 13 pertain to a fourth embodiment of the present disclosure, which is similar to the second embodiment in that it includes a base 10*c*, a nozzle assembly (not illustrated), a cap component 30*c* having an anchor member 32*c*, a lid 34*c* and a retainer cover (not illustrated), a first engagement component 40*c*, an indication component 50*c*. In the base 10*c*, a holding member 14*c* disposes on a foundation member 12*c*, in which an outlet channel 16 and an orifice 18 communicates with each other. In the cap component 30*c*, the anchor member 32*c* disposes on the lid 34*c*. A third engagement component (not illustrated) connects the retainer cover to the nozzle assembly.

In this case, the holding member 14*c* includes two resilient plates 142*c* opposite to each other and a gap 144*c* formed between the interior sides of the two resilient plates 142*c*.

The first engagement component 40*c* includes a first male member 42*c* and a first female member 44*c* mating with each other. The first male member 42*c* is a clip tab arranged on an exterior side of each of the resilient plates 142*c*, and the first female member 44*c* is a pair of mounting holes arranged on the anchor member 32*c*. The first engagement component 40*c* connects the resilient plates 142*c* of the holding member 14*c* to the lid 34*c* of the cap component 30*c* by a converging movement between the holding member 14*c* and the anchor member 32*c*.

The indication component 50*c* includes a sign portion 58*c* aligning with an orifice 18*c* of the base 10*c*; the indication component 50*c* could be slightly bulged on the lid 34*c* for visual recognition.

A reception 60*c* is arranged on the anchor member 32*c* of the cap component 30*c* for accommodating the holding member 14*c* of the base 10*c*.

In an alternative embodiment (not illustrated), the first male member 42*c* of the first engagement component 40*c* is arranged on an interior side each of the resilient plates 142*c*, in which case the reception 60*c* is arranged on the holding member 14*c* of for accommodating the anchor member 32*c*.

Fifth Embodiment

Figure 15:
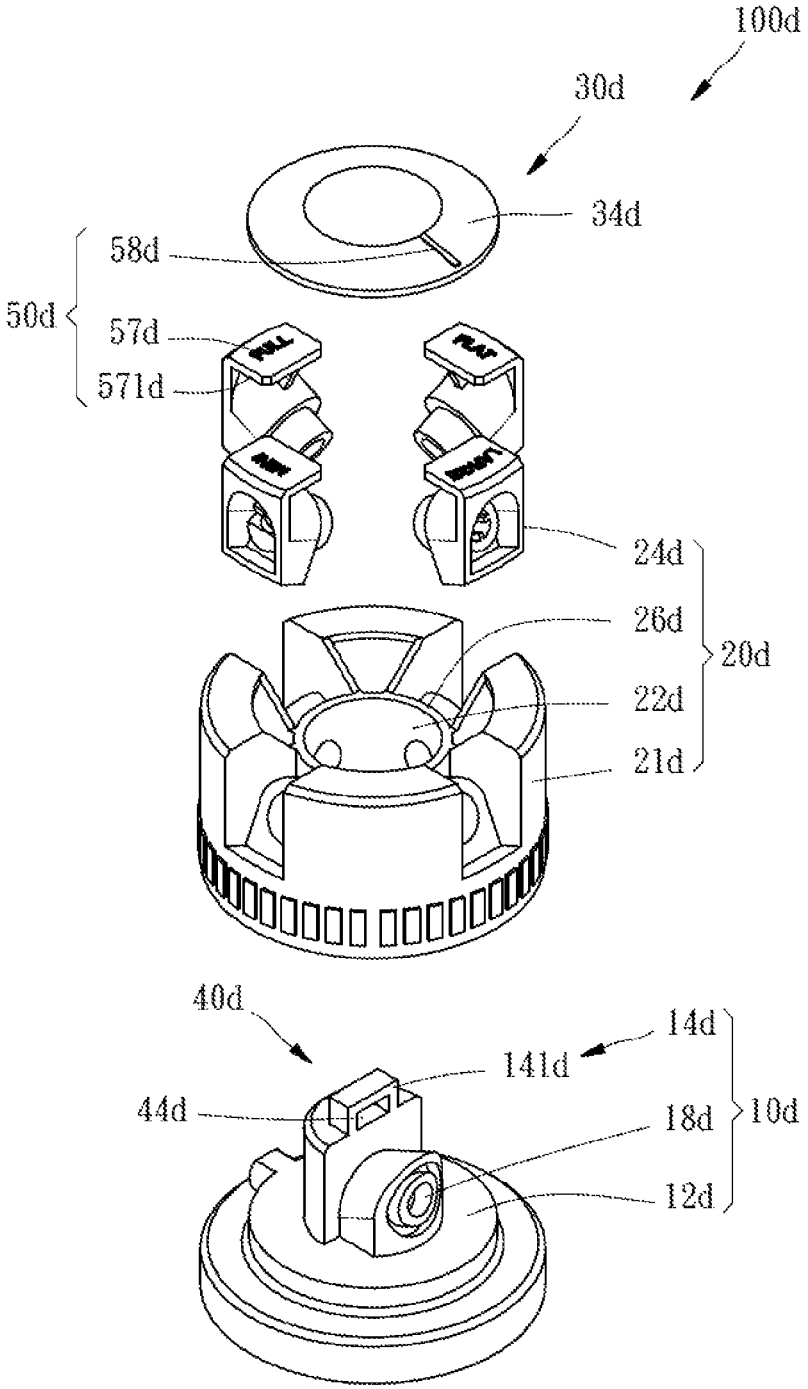
FIG. 15 is an explosion view in a top perspective illustrating an irrigation sprinkler in accordance to the fifth embodiment of the present disclosure.
Figure 16:
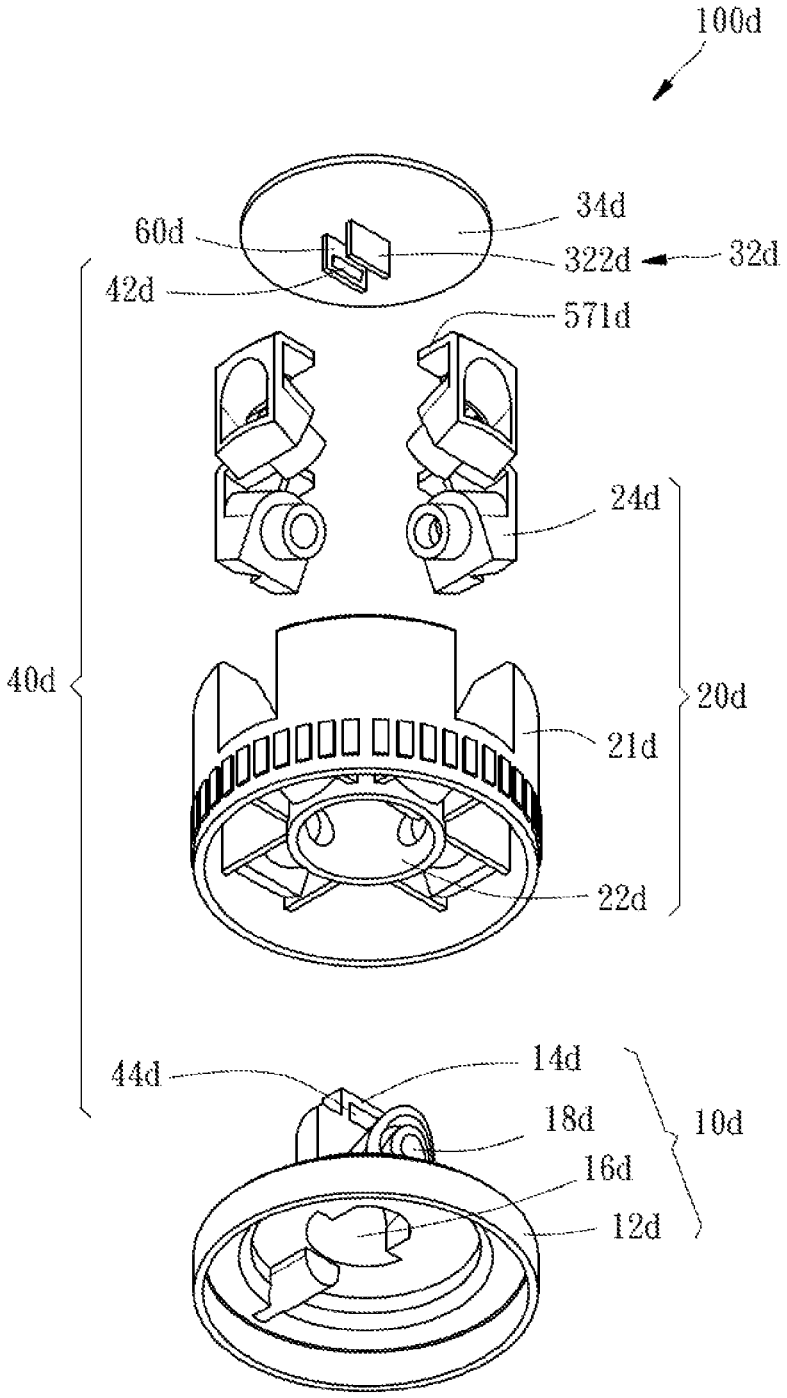
FIG. 16 is an explosion view in a bottom perspective illustrating an irrigation sprinkler in accordance to the fifth embodiment of the present disclosure.

FIGS. 14 to 16 pertain to a fifth embodiment of the present disclosure. The irrigation sprinkler 100*d* includes a base 10*d*, a nozzle assembly 20*d*, a cap component 30*d*, a first engagement component 40*d*, and an indication component 50*d*.

The base 10*d* includes a foundation member 12*d*, and a holding member 14*d* disposed on the foundation member 12*d*; the base 10*d* defines an outlet channel 16*d* formed in the foundation member 12*d* and communicating with the water source, and an orifice 18*d* formed on the foundation member 12*d* and communicating with the outlet channel 16*d*.

The nozzle assembly 20*d* slidably attaches to the base 10*d* and is capable of rotating around a generally vertical axis of the base 10*d*. The nozzle assembly 20*d* includes a housing 21*d* defining a top, a passage 22*d* formed through the housing 21*d*, and a plurality of nozzles 24*d* circumferentially arranged in the housing 21*d* and spaced apart. The holding member 14*d* of the base 10*d* penetrates the passage 22*d* of the nozzle assembly 20*d*. The nozzles 24*d* offer various spray patterns.

The cap component 30*d* sits over the base 10*d* and the nozzle assembly 20*d*. The cap component 30*d* includes a lid 34*d*, and an anchor member 32*d* disposed on the lid 34*d*.

The first engagement component 40*d* includes a first male member 42*d* and a first female member 44*d* mating with each other. The first male member 42*d* non-releasably couples with the first female member 44*d* by a converging movement between the holding member 14*d* and the anchor member 32*d*, so that the first engagement component 40*d* connects the cap component 30*d* to the base 10*d*. The nozzle assembly 20*d* is consequently restrained between the cap component 30*d* and the base 10*d* after the converging movement.

The indication component 50*d* includes a sign portion 58*d* arranged on the lid 34*d* of the cap component 30*d* and aligns with the orifice 18*d* of the base 10*d*. The sign portion 58*d* could be further recessed or bulged in option, and sequentially could be visible on the cap component 30*d*. In the case, the sign portion 58*d* is a strip-like bulge. Furthermore, the indication component 50*d* includes a plurality of marks 57*d* set on the nozzle assembly 20*d* and respectively coincided with the nozzles 24*d*. In addition, the indication component 50*d* includes a plurality of tabs 571*d* respectively coinciding with the nozzles 24*d*. The sign portion 58*d* is capable of pointing out a selected one of the marks 57*d* after the nozzle assembly 20*d* rotates.

Further in detail, the holding member 14*d* includes a pillar 141*d*. The anchor member 32*d* includes two resilient plates 322*d* opposite to each other. The first male member 42*d* is a clip tab arranged on an interior of each of the two resilient plates 322*d* of the anchor member 32*d*, and the first female member 44*d* is a mounting hole arranged through the pillar 141*d* of the holding member 14*d*.

Further in detail, a reception 60*d* is formed between the two resilient plates 322*d* of the anchor member 32*d* for accommodating the holding member 14 of the base 10.

In an alternative embodiment (not illustrated), each of the tabs 571*d* is formed without mark 57*d* and is substantially embedded on an exterior of the nozzle assembly 20*d*. The tabs 571*d* are variously colored for visual recognition on a selected one of the nozzles 24*d*.

In an alternative embodiment (not illustrated), the sign portion 58*d* could be replaced by a window, which is capable of revealing a selected one of the marks 57*d* after the nozzle assembly 20*d* rotates.

Therefore, the irrigation sprinkler in the present disclosure offers convenient assembly without screws. Instead of screws, two parts of the first engagement component are respectively arranged on the cap component and the base, and the first engagement component connects the cap component to the base by a converging movement. The irrigation sprinkler further provides easy manipulation for users fully grasping the irrigation sprinkler from top to rotate the nozzle assembly. The irrigation sprinkler further provides visual identification for the users to recognize the selected nozzle and the spray direction.

The preceding description is meant to be illustrative of preferred embodiments and should not be construed as limiting the scope of the present disclosure. Various modifications, which would be readily apparent to one skilled in the art, are intended to be within the scope of the present disclosure. Accordingly, the only limitations to the scope of the present disclosure are set forth in the following claims appended hereto.

What is claimed is:

1. An irrigation sprinkler, adapted for connecting to a water source, comprising:

a base defining an orifice communicating with the water source, and including a holding member disposed thereon;

a nozzle assembly slidably attaching to the base and being capable of rotating around a generally vertical axis of the base; the nozzle assembly defining a plurality of nozzles circumferentially arranged thereof and spaced apart; the nozzle assembly further defining a passage through which the holding member of the base penetrates;

a cap component sitting over the base and the nozzle assembly; the cap component having an anchor member corresponding to the holding member of the base;

a first engagement component including a first male member and a first female member; the first male member being alternatively arranged on the holding member of the base and the anchor member of the cap component, and the first female member being arranged on the other; wherein the first male member non-releasably couples with the first female member by converging movement between the holding member and the anchor member, and the first engagement component connects the cap component to the base; wherein the nozzle assembly is restrained between the cap component and the base; and an indication component coupling with the cap component and corresponding to the orifice of the base; whereby a rotation of the nozzle assembly enables the indication component to align with a selected one of the nozzles, which communicates with the orifice of the base, and offers visual recognition of the selected one of the nozzles.

2. The irrigation sprinkler as claimed in claim 1, wherein the cap component includes a slot; the indication component defines a slide tab; the slide tab glides within the slot.

3. The irrigation sprinkler as claimed in claim 2, wherein the cap component includes a lid, a retainer cover, and a second engagement component coupling the lid to the retainer cover;

the anchor member arranged in the retainer cover, and both of the lid and the retainer cover of the cap component are non-releasable to the base;

the slot is formed transversely on the retainer cover;

whereby the slide tab glides within the slot of the retainer cover, and the anchor member travels within the opening while the slide tab glides.

4. The irrigation sprinkler as claimed in claim 1, wherein the cap component includes a lid and a retainer cover relatively movable to each other; the retainer cover is non-releasable to the nozzle assembly; the anchor member is arranged on the lid.

5. The irrigation sprinkler as claimed in claim 4, wherein the indication component includes a sign window and a sign portion corresponding with each other;

the sign window is formed on the lid of the cap component and aligns with the orifice of the base; the sign portion extends from the holding member of the base toward the lid of the component for fitting in the sign window.

6. The irrigation sprinkler as claimed in claim 5, wherein the indication component includes a plurality of marks set on the retainer cover and respectively coincided with the nozzles; the sign portion is capable of pointing out a selected one of the marks after the retainer cover synchronously rotates with the nozzle assembly.

7. The irrigation sprinkler as claimed in claim 4, wherein the indication component includes a sign window and a plurality of marks; the sign window is formed on the lid of the cap component and aligns with the orifice of the base; the marks are set on the retainer cover beneath the lid and respectively coincided with the nozzles; the sign window is capable of revealing a selected one of the marks after the retainer cover synchronously rotates with the nozzle assembly.

8. The irrigation sprinkler as claimed in claim 4, wherein the indication component includes a sign portion arranged on the lid of the cap component and aligned with the orifice of the base, and a plurality of marks set on the retainer cover and respectively coincided with the nozzles.

9. The irrigation sprinkler as claimed in claim 1, wherein the cap component includes a lid, a retainer cover arranged between the lid and the nozzle assembly, and a third engagement component connecting the retainer cover to the nozzle assembly;

the third engagement component includes at least one third male member and at least one third female member; the third male member is alternatively arranged on the retainer cover and the nozzle assembly, and the third female member is arranged on the other; the retainer cover is non-rotatable to the nozzle assembly, and relatively rotatable to the lid;

the anchor member arranged on the lid, and the lid of the cap component is non-releasable to the base.

10. The irrigation sprinkler as claimed in claim 1, wherein the indication component includes a sign portion arranged on an exterior of the cap component and aligned with the orifice of the base.

11. The irrigation sprinkler as claimed in claim 10, wherein the indication component includes a plurality of marks set upon the nozzle assembly and respectively coincided with the nozzles; the sign portion is capable of pointing out a selected one of the marks after the nozzle assembly rotates.

12. The irrigation sprinkler as claimed in claim 10, wherein the nozzle assembly includes a housing defining a top; the passage is formed through the housing, the nozzles are circumferentially arranged in the housing; the indication component includes a plurality of tabs respectively coinciding with the nozzles and colored.

13. The irrigation sprinkler as claimed in claim 10, wherein the nozzle assembly includes a housing defining a top; the passage is formed through the housing; the indication component includes a plurality of tabs respectively coinciding with the nozzles, and a plurality of marks respectively set on the tabs of the nozzle assembly.

14. The irrigation sprinkler as claimed in claim 1, wherein at least one resilient plate, on which the first male member is arranged, is alternatively arranged on the holding member of the base and the anchor member of the cap component, and the first female member is arranged on the other.

15. The irrigation sprinkler as claimed in claim 1, wherein at least one resilient plate, on which the first female member is arranged, is alternatively arranged on the holding member of the base and the anchor member of the cap component, and the first male member is arranged on the other.

16. The irrigation sprinkler as claimed in claim 1, wherein the first male member is a bulge, and the first female member is a recess.

17. The irrigation sprinkler as claimed in claim 1, further including a reception alternatively arranged on the holding member of the base and the anchor member of the cap component, for accommodating the other.

* * * * *